US006916229B2

(12) United States Patent
Kao et al.

(10) Patent No.: US 6,916,229 B2
(45) Date of Patent: Jul. 12, 2005

(54) MACHINE-IMPLEMENTED METHOD FOR FORMING A RELEASE SURFACE OF A MOLD

(75) Inventors: Po-Sung Kao, Taichung (TW); Sheng-Jui Chao, Taichung (TW)

(73) Assignee: Asia Optical Co., Inc., Taichung (TW)

( * ) Notice: Subject to any disclaimer, the term of this patent is extended or adjusted under 35 U.S.C. 154(b) by 0 days.

(21) Appl. No.: 10/741,276

(22) Filed: Dec. 18, 2003

(65) Prior Publication Data

US 2005/0020195 A1 Jan. 27, 2005

(30) Foreign Application Priority Data

Jul. 21, 2003 (TW) ..... 92119856 A

(51) Int. Cl.[7] ..... B24B 1/00

(52) U.S. Cl. ..... 451/58; 451/28; 451/41; 451/51; 451/61

(58) Field of Search ..... 451/58, 211, 51, 451/61, 57, 462, 412, 28, 43, 44, 240, 255, 256, 277, 323; 29/557, 888.07; 606/86; 409/219, 164, 132, 138, 165; 408/219, 1 R; 65/37, 61, 181; 351/177

(56) References Cited

U.S. PATENT DOCUMENTS 3,526,060 A * 9/1970 Radford et al. ..... 451/211
4,513,542 A * 4/1985 Wilger et al. ..... 451/439
4,704,825 A * 11/1987 Moore ..... 451/5
5,934,976 A * 8/1999 Makino et al. ..... 451/28
5,974,641 A * 11/1999 Hogue ..... 42/78
6,007,281 A * 12/1999 Eriksson et al. ..... 409/132
6,086,592 A * 7/2000 Rosenberg et al. ..... 606/86
6,616,508 B1 * 9/2003 Kamamura et al. ..... 451/8
6,761,516 B2 * 7/2004 Pham ..... 409/132
6,842,963 B2 * 1/2005 Kao et al. ..... 29/557

* cited by examiner

*Primary Examiner*—George Nguyen
(74) *Attorney, Agent, or Firm*—Townsend and Townsend and Crew LLP

(57) ABSTRACT

A machine-implemented method is provided for forming a release surface of a mold. The mold has a mold cavity confined by an inner peripheral surface defining a mold cavity axis. The method includes the steps of: (a) bringing a grinding surface of a rotary grinding portion of a jig grinder into contact with a part of the inner peripheral surface such that the grinding surface is inclined at a predetermined angle relative to the mold cavity axis, and rotating the grinding portion such that the grinding surface grinds the part of the inner peripheral surface; (b) separating the grinding surface from the inner peripheral surface; (c) changing relative positions of the grinding portion and the inner peripheral surface in preparation for grinding another part of the inner peripheral surface; and (d) repeating the steps (a) to (c) until the release surface is formed.

21 Claims, 17 Drawing Sheets

MACHINE-IMPLEMENTED METHOD FOR FORMING A RELEASE SURFACE OF A MOLD

CROSS-REFERENCE TO RELATED APPLICATION

This application claims priority of Taiwanese Application No. 092119856, filed on Jul. 21, 2003.

BACKGROUND OF THE INVENTION

1. Field of the Invention

The invention relates to a machine-implemented method for forming a release surface of a mold.

2. Description of the Related Art

Referring to FIGS. 1 to 3, a conventional mold 1 for forming a plastic lens 3 is shown to have a mold cavity 101 for receiving a mold core 4, and an inner peripheral surface 102 that defines the mold cavity 101. The inner peripheral surface 102 has a top peripheral portion 1021. An electrical discharge machining process for forming a release surface 1023 of the mold 1 is conducted on the top peripheral portion 1021 using an electrode 5. The release surface 1023 thus formed has a configuration corresponding to that of the electrode 5. In order to improve the smoothness of the release surface 1023, it is required to further polish the release surface 1023 by using oilstones or diamond pastes so as to enhance the releasability of the lens 3 formed thereby from the mold 1.

The conventional electrical discharge machining process has the following disadvantages:

1. Since the electrical discharge machining process is time-consuming and costly, the conventional method of forming the release surface 1023 of the mold 1 involves relatively high production costs. The conventional method is also difficult to control. In addition, the production precision associated with the electrical discharge machining process is limited by a plurality of factors, such as discharge gap, current amount, etc.

2. Referring to FIG. 2, the release surface 1023 of the mold 1 made by the electrical discharge machining process is formed with a plurality of undesired recesses 1024 due to arc discharge. Therefore, the surface roughness of the release surface 1023 is merely about 0.4 $\mu$m. An additional manual grinding process is required to polish the release surface 1023 in the conventional method.

3. Although the surface roughness of the release surface 1023 can be improved by the manual grinding process, the recesses 1024 formed on the release surface 1023 of the mold 1 can not be polished away completely by the manual grinding process. Therefore, the peripheral portion of the lens 3 may be abrasive.

4. Referring again to FIG. 2, the release surface 1023 is usually formed with an undesired beveled portion 1025 during the electrical discharge machining process. The beveled portion 1025 of the release surface 1023 should be removed by a further processing, such as by grinding.

SUMMARY OF THE INVENTION

Therefore, the object of the present invention is to provide a machine-implemented method for forming a release surface of a mold with advantages of relatively fast processing, relatively low production costs, and relatively high precision.

The machine-implemented method for forming a release surface of a mold according to this invention, in which the mold has a mold cavity confined by an inner peripheral surface defining a mold cavity axis, and in which the release surface is to be formed at the inner peripheral surface and is inclined relative to the mold cavity axis, includes the steps of:

(a) bringing a grinding surface of a rotary grinding portion of a jig grinder into contact with a part of the inner peripheral surface such that the grinding surface is inclined at a predetermined angle relative to the mold cavity axis, and rotating the grinding portion such that the grinding surface grinds the part of the inner peripheral surface;

(b) separating the grinding surface from the inner peripheral surface;

(c) changing relative positions of the grinding portion and the inner peripheral surface in preparation for grinding another part of the inner peripheral surface; and (d) repeating the steps (a) to (c) until the release surface is formed.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
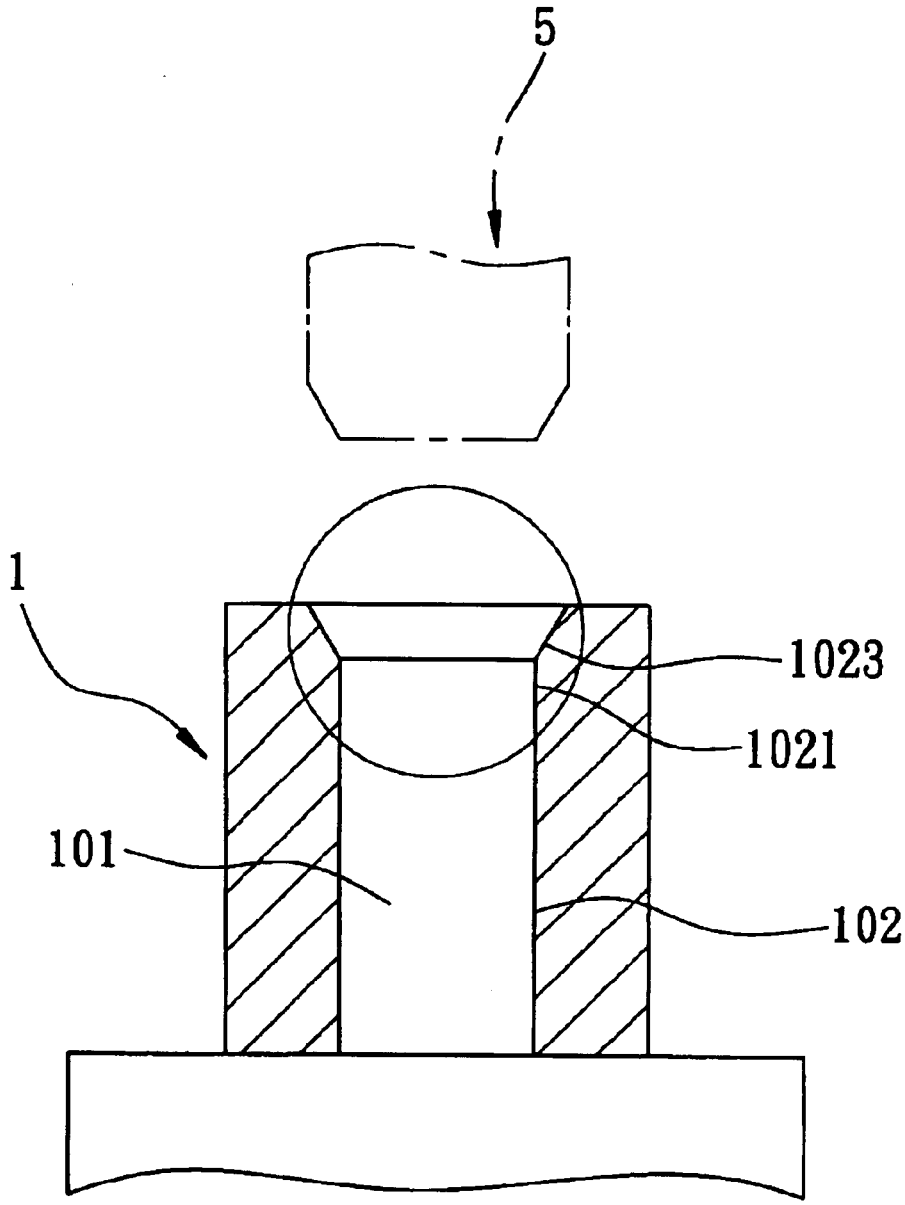
FIG. 1 PRIOR ART
FIG. 1 is a partly sectional schematic view of a mold having a release surface formed by a conventional electrical discharge machining process.
Figure 2:
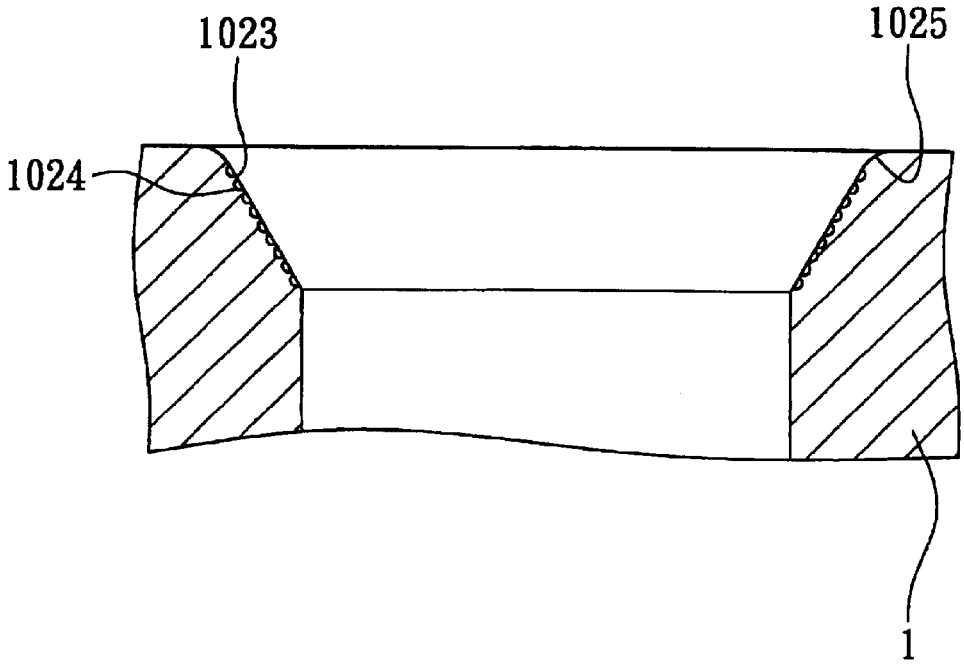
FIG. 2 PRIOR ART
FIG. 2 is an enlarged sectional schematic view illustrating the release surface of the mold of FIG. 1.
Figure 3:
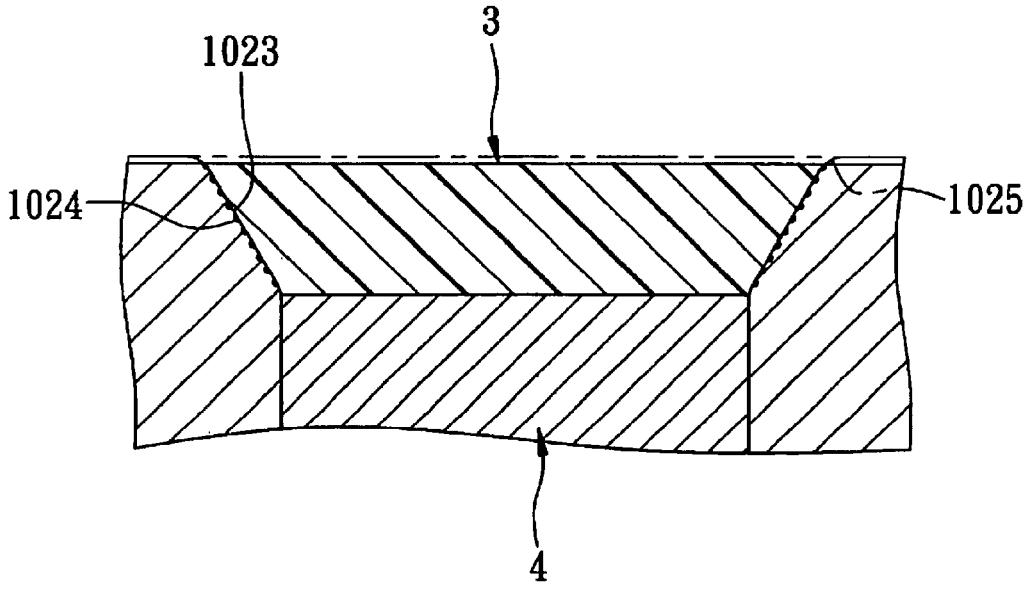
FIG. 3 PRIOR ART
FIG. 3 is an enlarged sectional schematic view illustrating the release surface of the mold after a further manual grinding process.

Before the present invention is described in greater detail, it should be noted that like elements are denoted by the same reference numerals throughout the disclosure.

Figure 4:
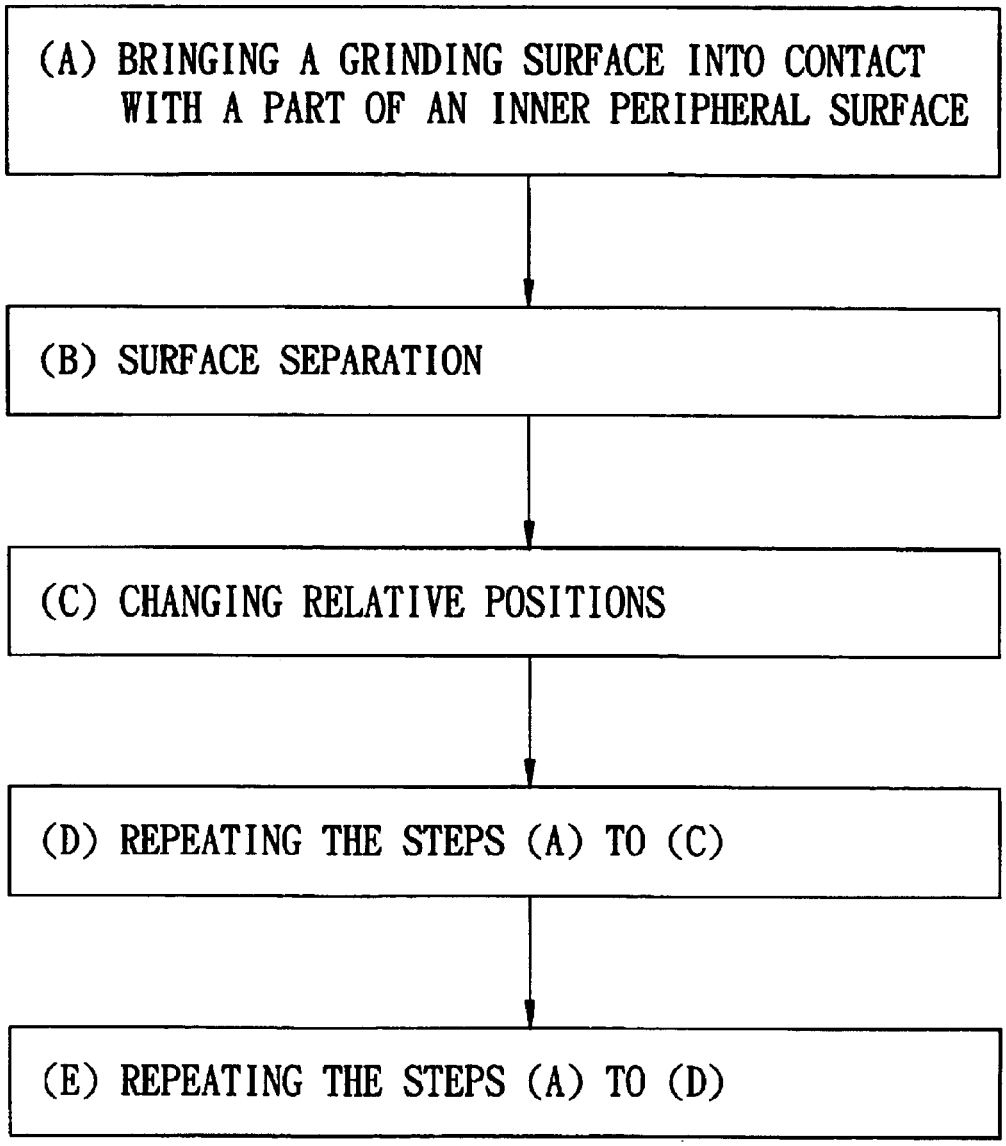
FIG. 4 is a flow diagram of the first preferred embodiment of a machine-implemented method for forming a release surface of a mold according to this invention.
Figure 5:
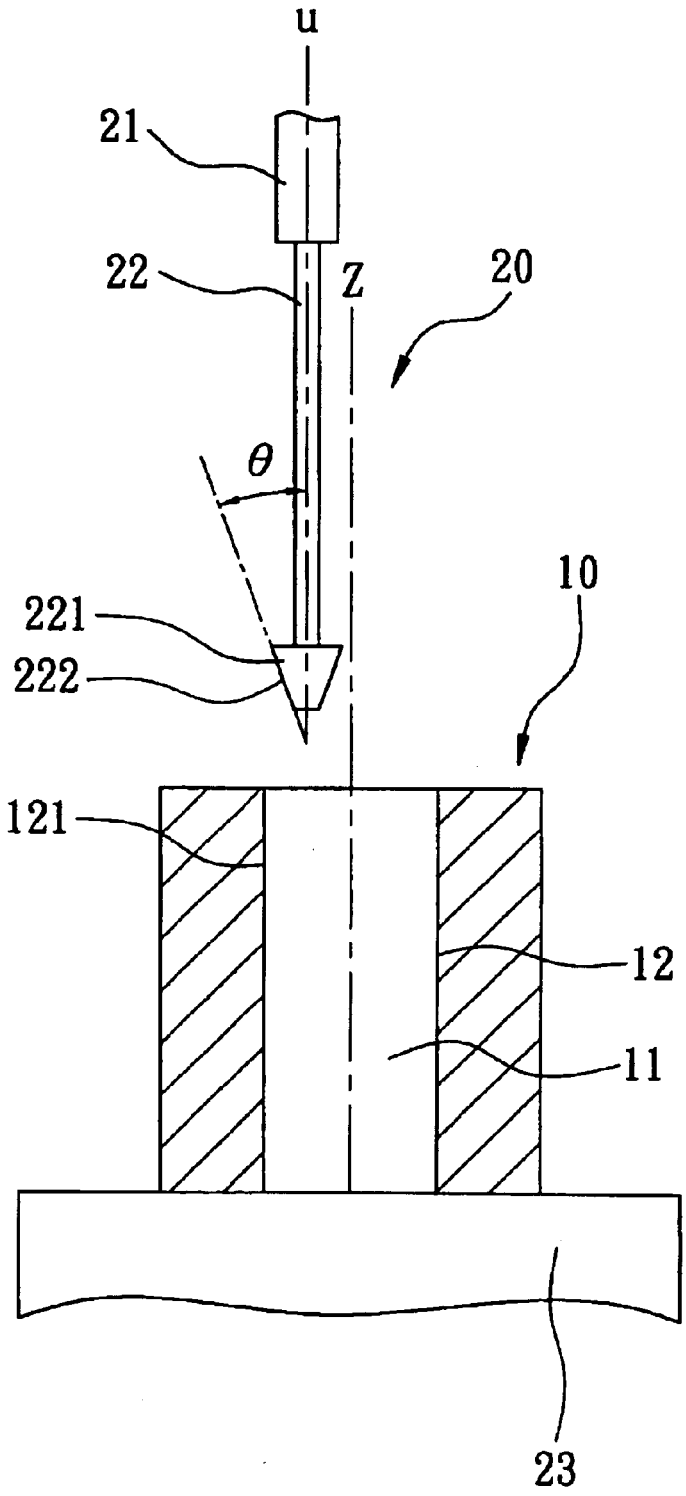
FIGS. 5 to 10 are schematic views illustrating consecutive steps of the first preferred embodiment.
Figure 6:
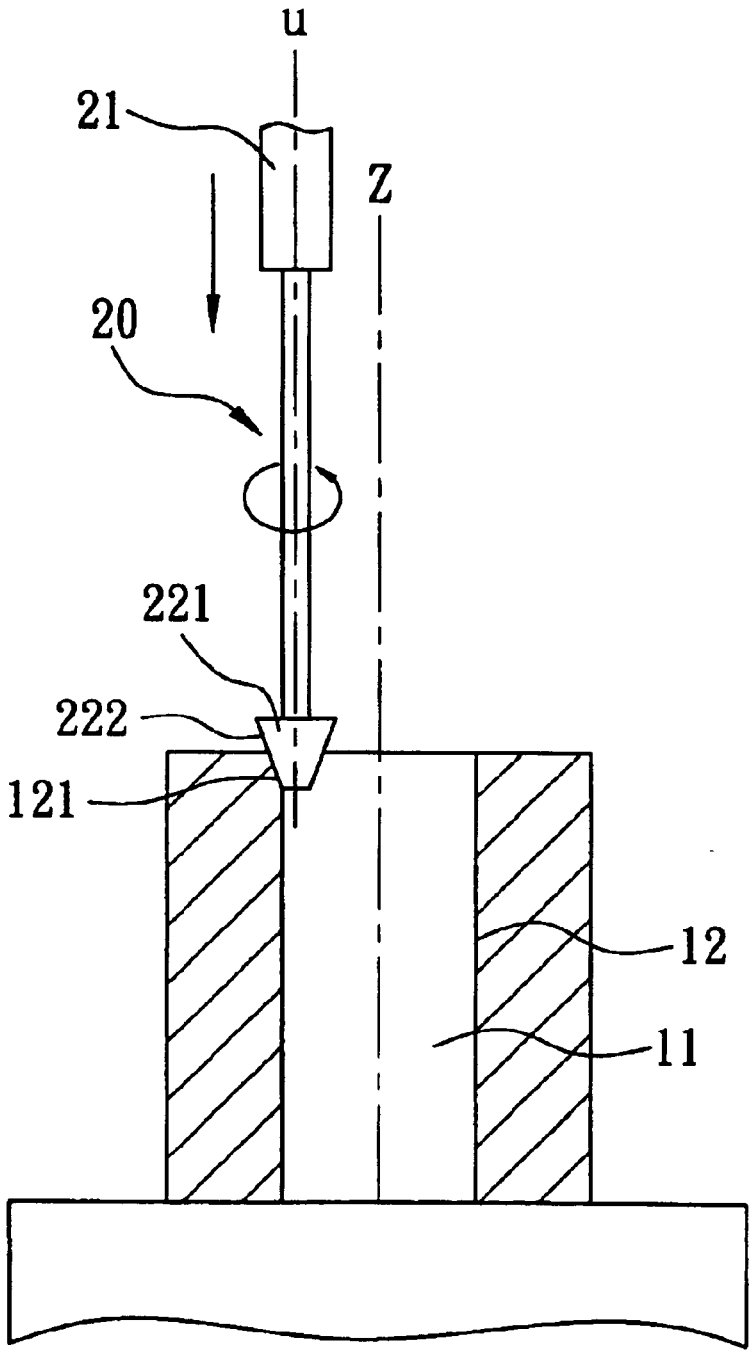
Figure 10:
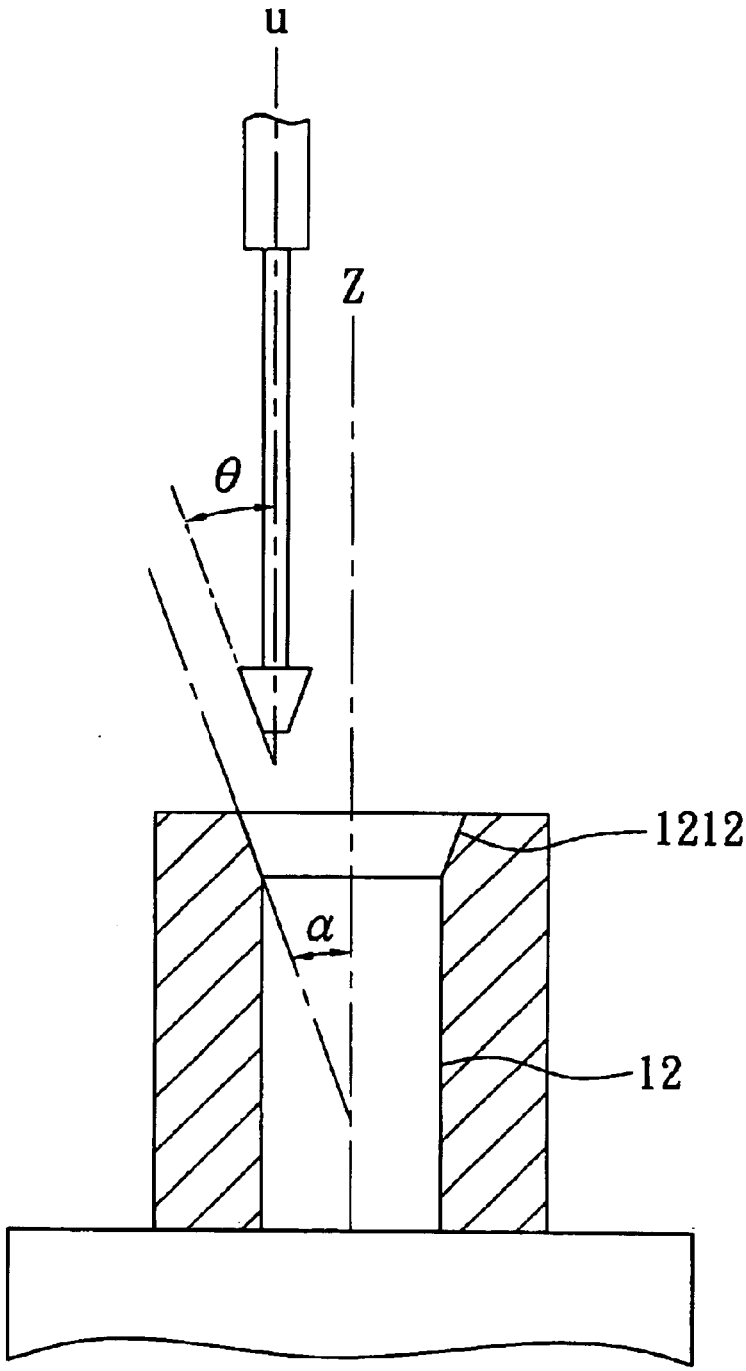
Figure 11:
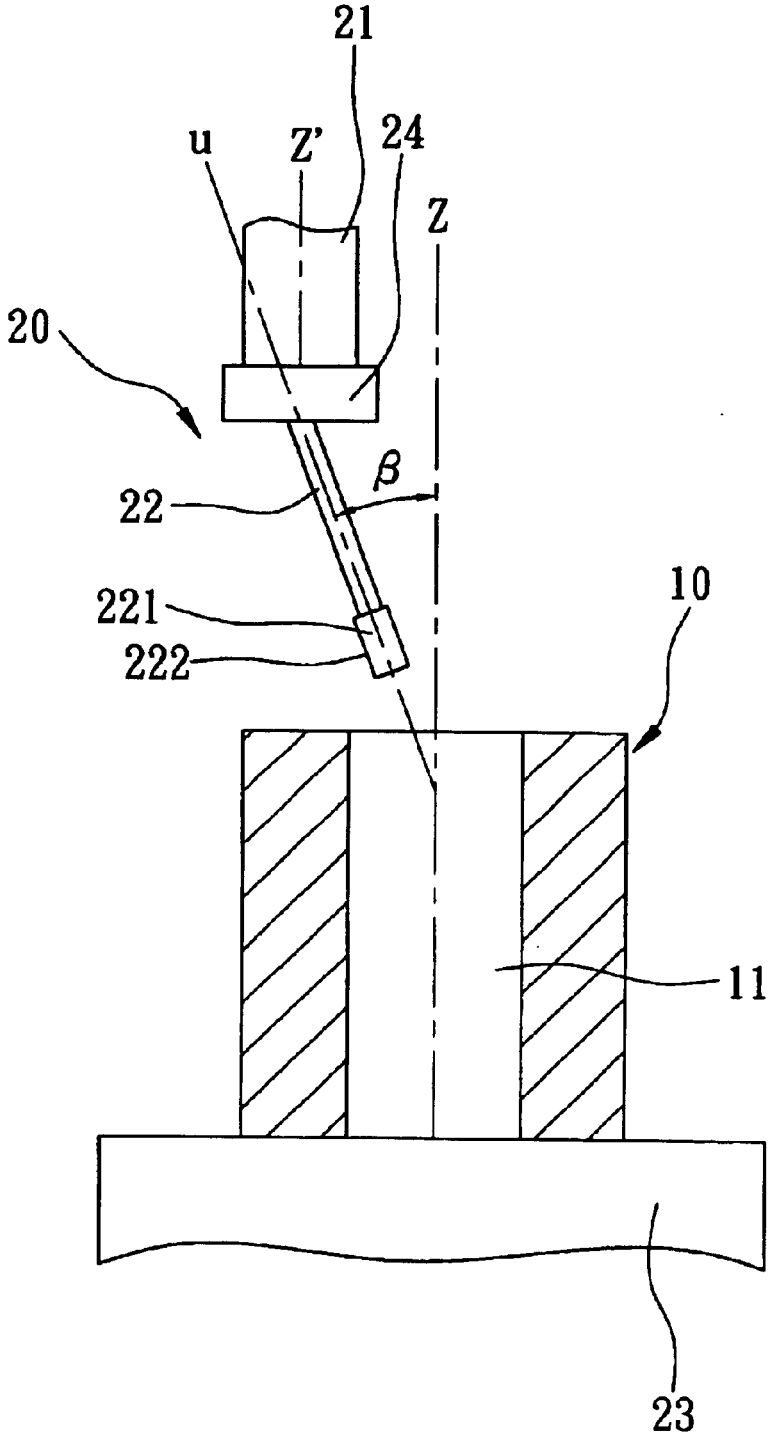
FIGS. 11 to 15 illustrate steps of the second preferred embodiment of a machine-implemented method for forming a release surface of a mold according to this invention.
Figure 12:
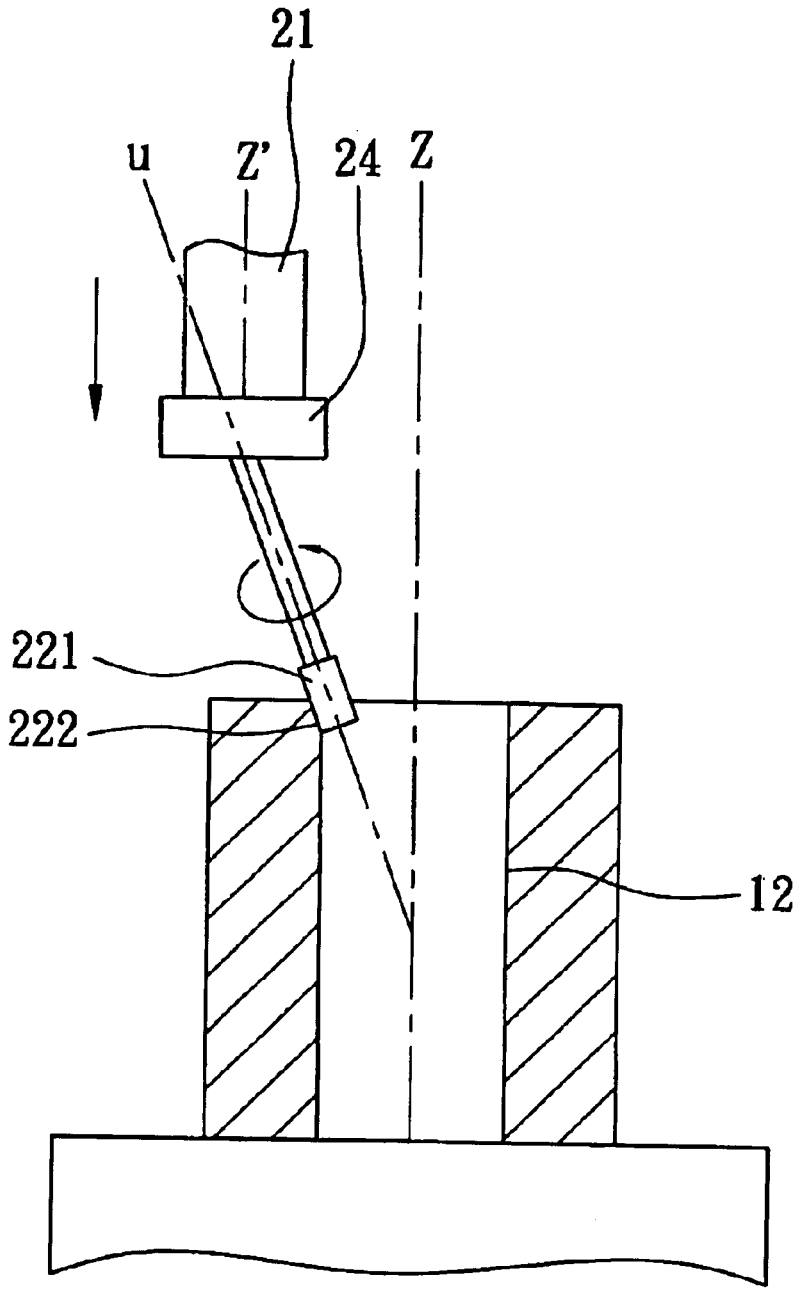
Figure 13:
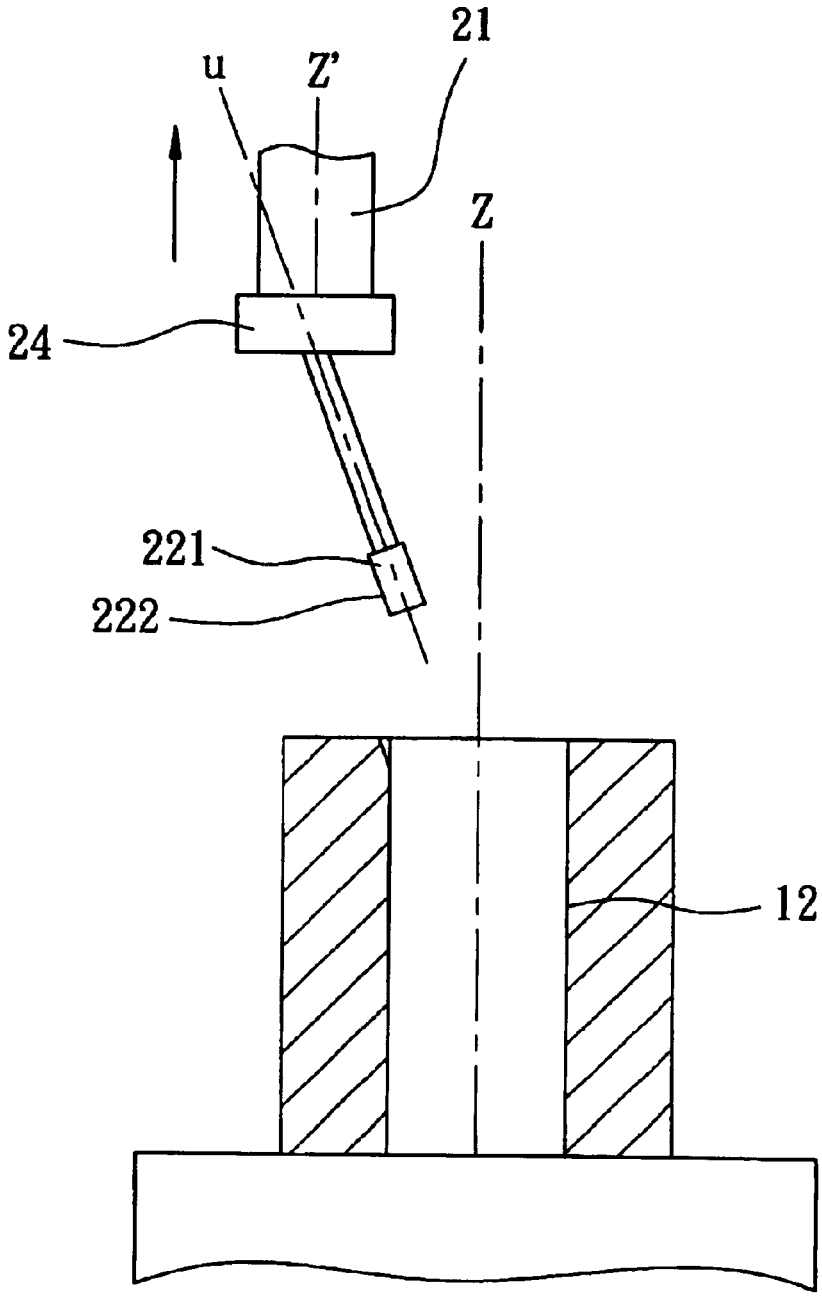
Figure 14:
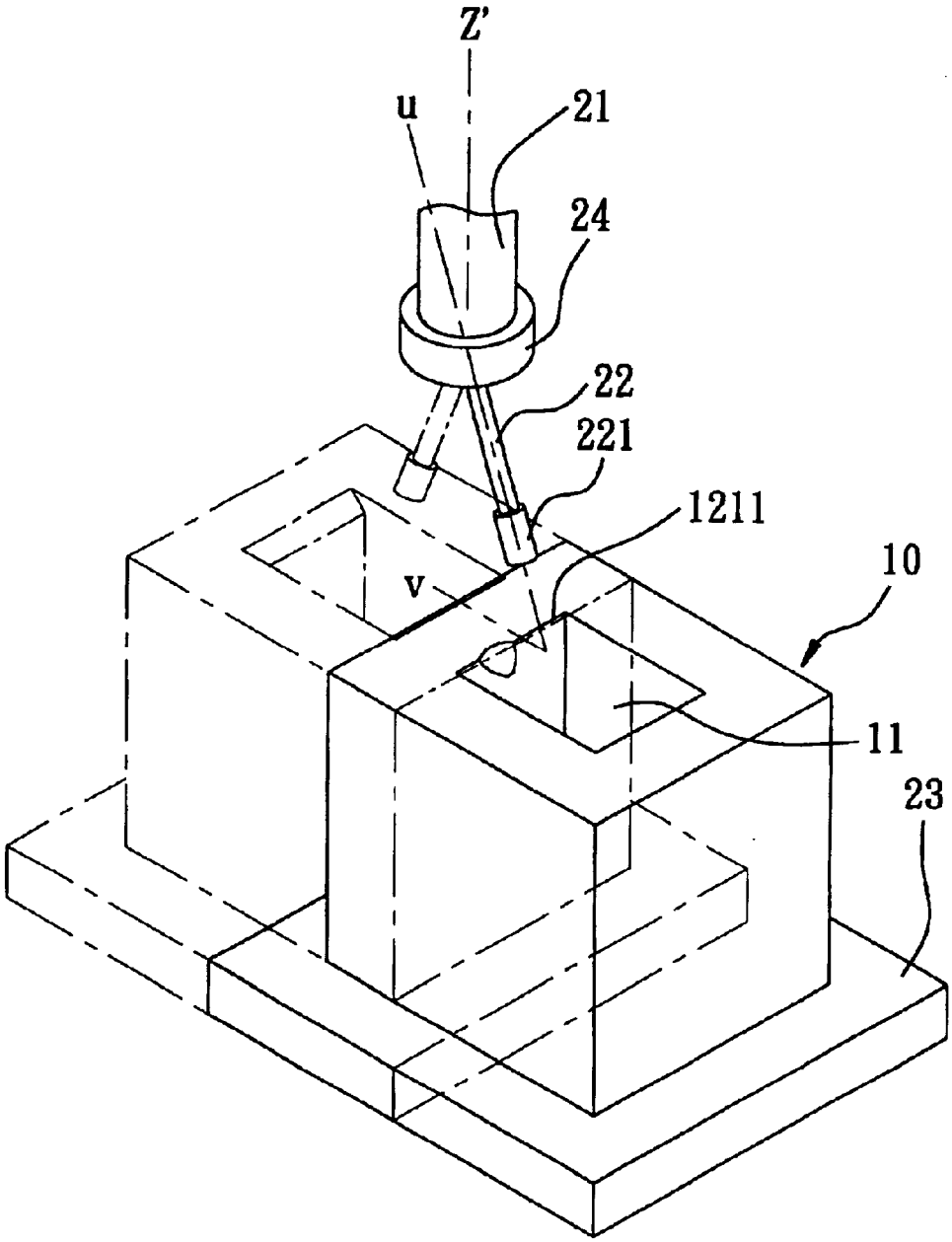

Referring to FIG. 4, the first preferred embodiment of the machine-implemented method for forming a release surface of a mold 10 is shown. Referring to FIG. 5, the mold 10 has a mold cavity 11 confined by an inner peripheral surface 12 that defines a mold cavity axis (Z). A conventional jig grinder 20 is provided for implementing the method for forming the release surface 1212 (see FIG. 10) of the mold 10. The jig grinder 20 includes a main shaft 21 defining a rotary axis (u) parallel to the mold cavity axis (Z), a rotary rod 22 mounted on the main shaft 21 along the rotary axis (u), and a rotary grinding portion 221 mounted on the rotary rod 22 distal from the main shaft 21. The rotary grinding portion 221 of the jig grinder 20 has a grinding surface 222, which is frusto-conical and which forms a predetermined angle (θ) relative to the rotary axis (u). The angle (θ) is smaller than 90 degrees. A worktable 23, also known as an "x-y table" in the art, is provided for placing the mold 10 thereon. Referring to FIG. 10, the release surface 1212 is to be formed at the inner peripheral surface 12 and is inclined relative to the mold cavity axis (Z) so as to form a releasing angle (α) relative to the mold cavity axis (Z). The releasing angle (α) is equal to the angle (θ). The main shaft 21 actuates the rotary rod 22 for rotating the rotary grinding portion 221 around the rotary axis (u) and to displace the rotary grinding portion 221 up and down along the rotary axis (u). The first preferred embodiment of the method of the present invention includes the following steps:

(a) bringing the grinding surface 222 into contact with a part of the inner peripheral surface 12:

Referring to FIGS. 5 and 6, the grinding portion 221 of the jig grinder 20 is moved into the mold cavity 11. The grinding surface 222 of the rotary grinding portion 221 of the jig grinder 20 is brought into contact with a part 121 of the inner peripheral surface 12 such that the grinding surface 222 is inclined at the predetermined angle (θ) relative to the mold cavity axis (Z), and the grinding portion 221 is rotated about the rotary axis (u) such that the grinding surface 222 grinds the part 121 of the inner peripheral surface 12.

Figure 7:
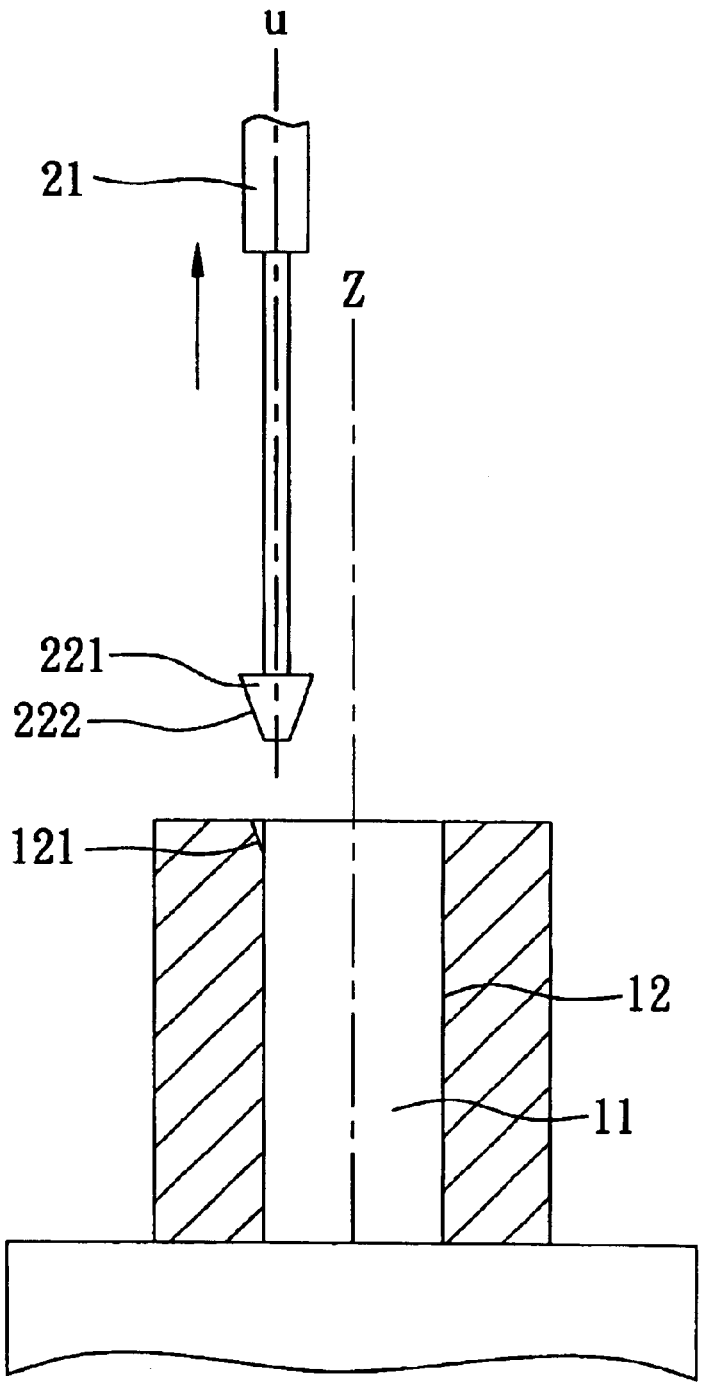

(b) surface separation:

Referring to FIG. 7, the grinding surface 222 of the grinding portion 221 is separated from the inner peripheral surface 121 by moving the grinding portion 221 out of the mold cavity 11 along a displacement axis coaxial with the rotary axis (u).

Figure 8:
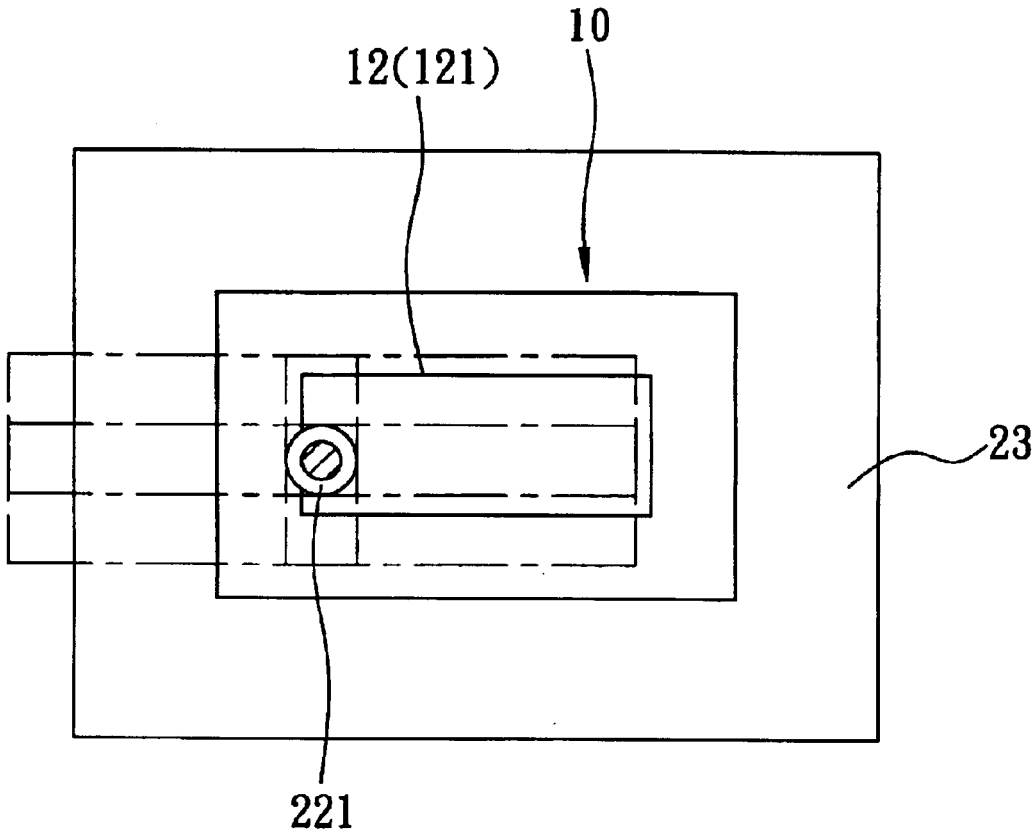

(c) changing relative positions:

Referring to FIG. 8, the relative positions of the grinding portion 221 and the inner peripheral surface 12 are changed by moving the worktable 23 on a plane perpendicular to the mold cavity axis (Z) in a conventional manner so as to displace the mold 10 relative to the grinding portion 221 in preparation for grinding another part of the inner peripheral surface 12.

(d) repeating steps (a) to (c):

The steps (a) to (c) are repeated to form the release surface having an initial depth relative to the mold cavity axis (Z).

Figure 9:
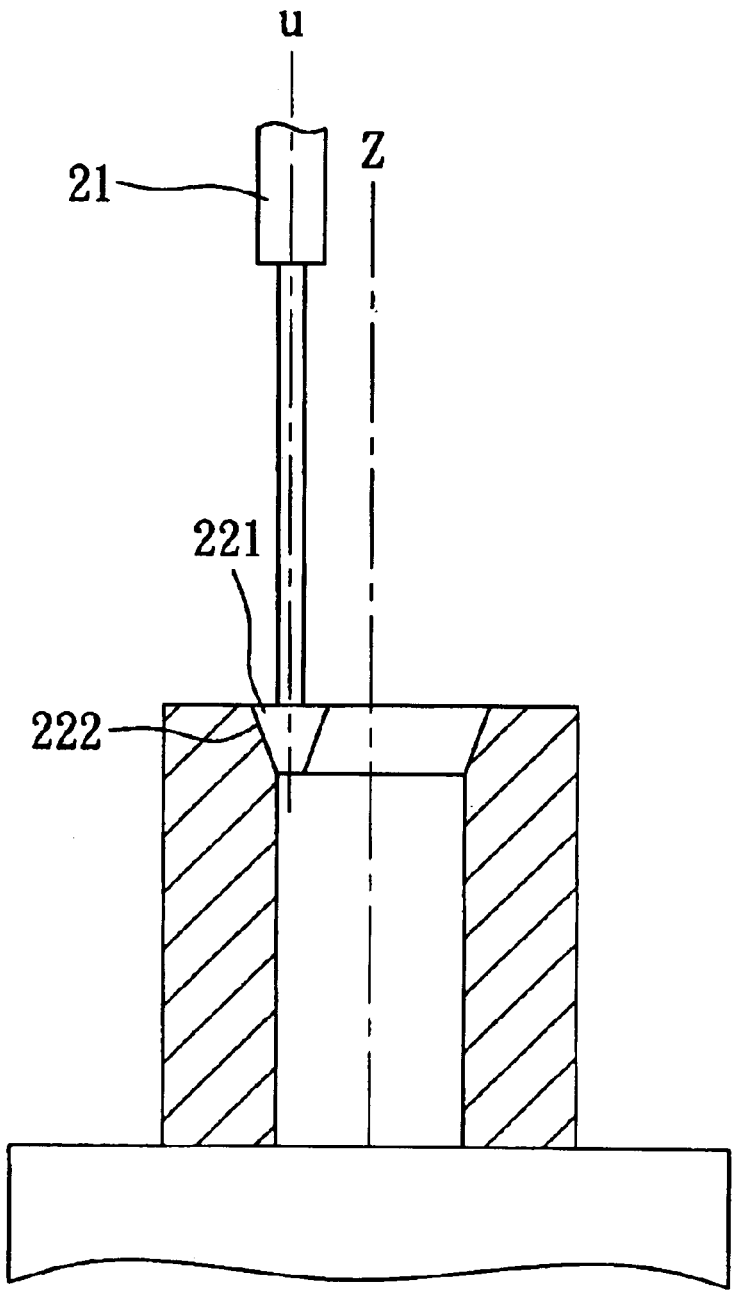

Referring to FIGS. 9 and 10, the steps (a) to (d) are thereafter repeated to form the release surface 1212 with a depth larger than the initial depth until a desired depth of the release surface 1212 is achieved. As described above, the releasing angle (α) of the release surface 1212 relative to the mold cavity axis (Z) is equal to the angle (θ) of the grinding surface 222 relative to the mold cavity axis (Z).

In view of the aforesaid, the following advantages over the prior art can be achieved by the machine-implemented method for forming the release surface 1212 of the mold 10 of this invention:

1. As compared to the electrical discharge machining process employed in the prior art, the method of the present invention reduces the cost and time for forming the release surface 1212 of the mold 10.

2. The problem of undesired recesses formed in the release surface and commonly encountered in the prior art can be avoided by the machine-implemented method of the present invention. The surface roughness of the release surface 1212 of the mold 10 formed by the method of the present invention can be as low as 0.1 μm. Therefore, the release surface 1212 of the mold 10 formed by the machine-implemented method of this invention does not need the additional polishing process required in the prior art. The machine-implemented method of this invention is thus relatively simple and easy to implement.

3. The releasing angle (α) of the release surface 1212 relative to the mold cavity axis (Z) can be precisely formed to be equal to the angle (θ) of the grinding surface 222 relative to the mold cavity axis (Z). The problem of forming an undesired beveled portion 1025 at the release surface 1023 of the prior art can be avoided in the machine-implemented method of this invention.

Referring to FIGS. 11 to 14, the second preferred embodiment of the machine-implemented method according to this invention is substantially identical to the first embodiment except for the following.

Figure 15:
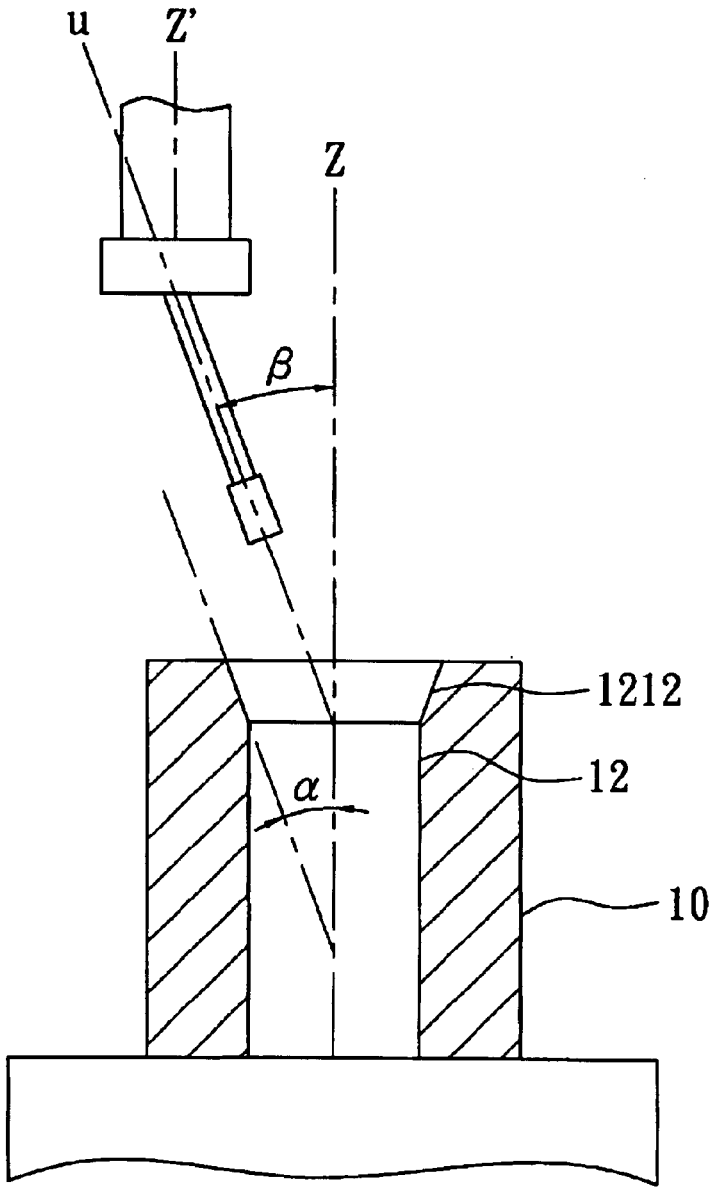

The jig grinder 20 used in the second preferred embodiment further includes an adjusting unit 24 mounted between the main shaft 21 and the rotary rod 22. The grinding portion 221 is rotatable about a rotary axis (u), and is moved into and out of the mold cavity 11 along a displacement axis (Z') parallel to the mold cavity axis (Z). The grinding surface 222 is cylindrical. The rotary axis (u) is inclined at a predetermined angle (β) relative to the mold cavity axis (Z) and the displacement axis (Z'). In this preferred embodiment, the release surface 1212 formed in the step (d) is a continuous surface. The machine-implemented method further includes, between the steps (c) and (d), a step of rotating the grinding portion 221 about the displacement axis (Z') through the adjusting unit 24 to adjust angular orientation of the grinding portion 221 relative to the inner peripheral surface 12 so that an imaginary projecting line (v) of the rotary axis (u) is kept normal to a corresponding segment of a top edge 1211 of the inner peripheral surface 12, thereby ensuring continuity of the release surface 1212 formed in the step (d). The release surface 1212 (see FIG. 15) of the mold 10 formed in the second preferred embodiment has the releasing angle (α) relative to the mold cavity axis (Z), which is equal to the predetermined angle (β) of the rotary axis (u) relative to the mold cavity axis (Z).

Figure 16:
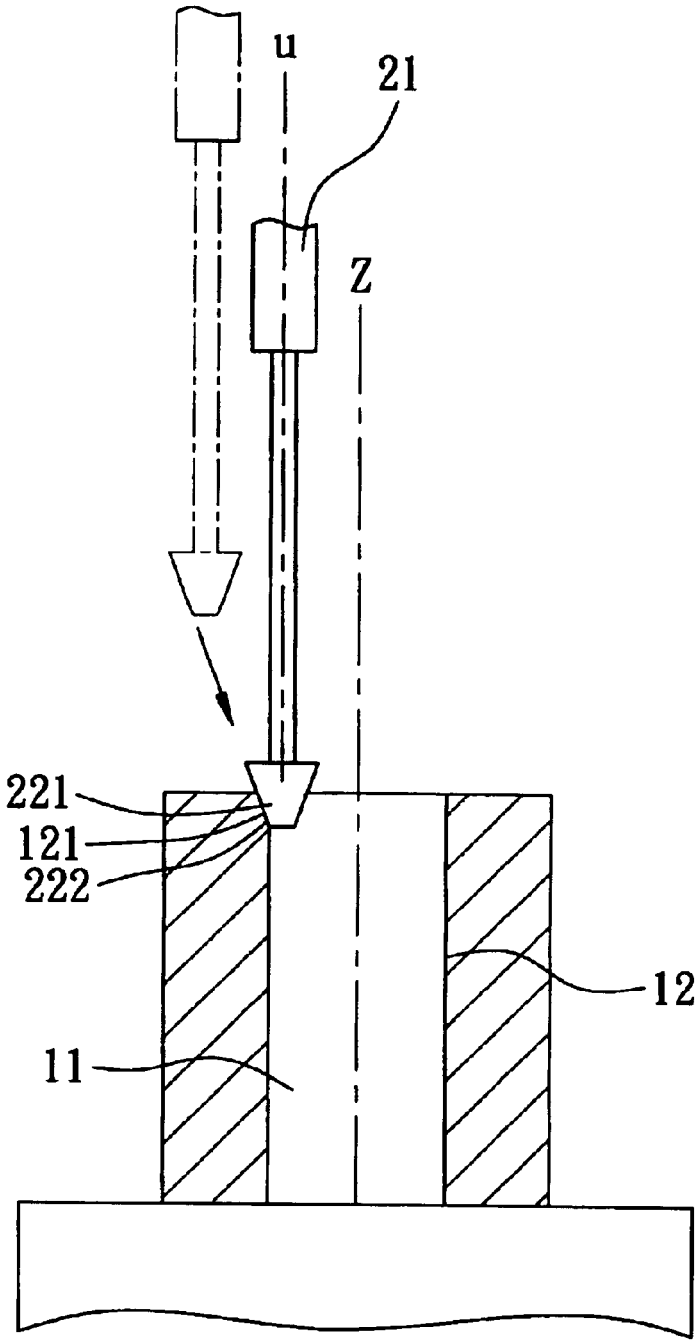
FIGS. 16 and 17 are partly sectional schematic views illustrating the third preferred embodiment of a machine-implemented method for forming a release surface of a mold according to this invention.
Figure 17:
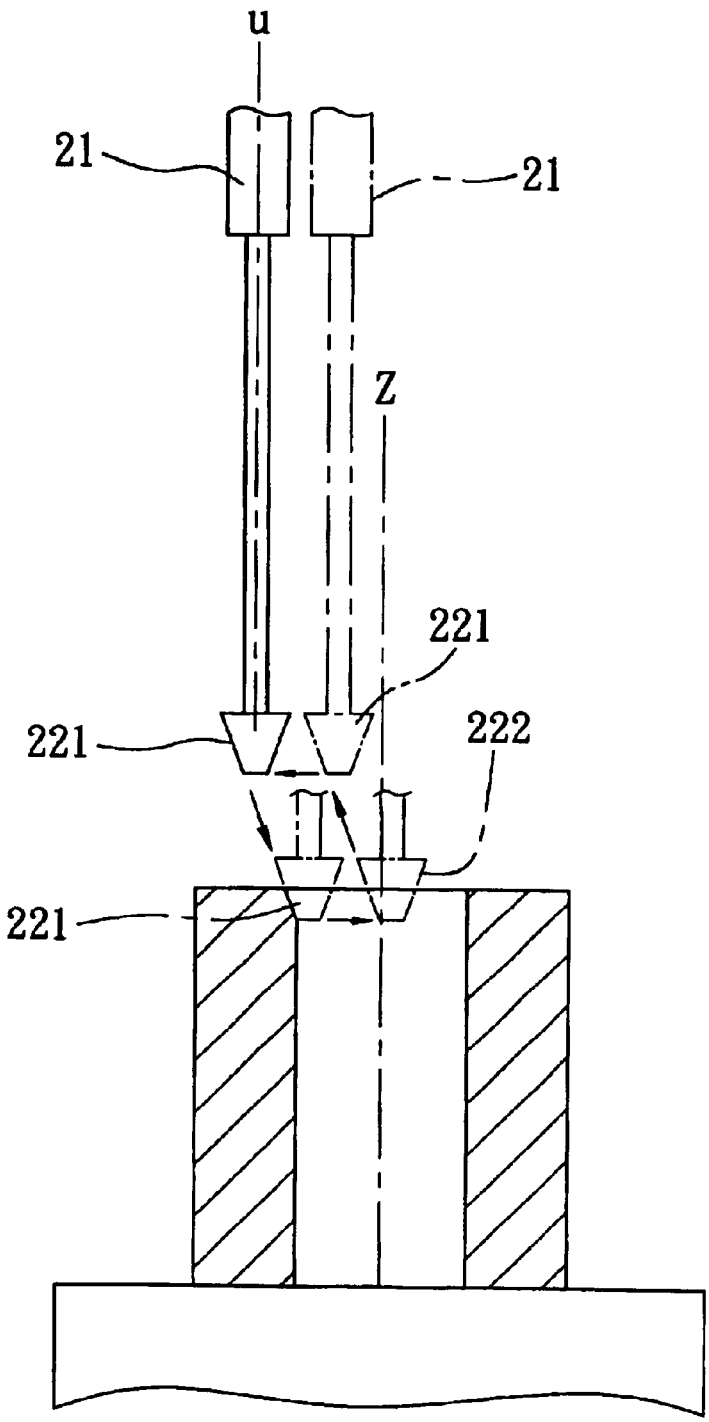

Referring to FIGS. 16 and 17, the third preferred embodiment of the machine-implemented method according to this invention is substantially identical to the first embodiment except for the following.

In step (a), the grinding portion 221 is moved inclinedly relative to the mold cavity axis (Z) from a first position outwardly of the mold cavity 11 to a second position within the mold cavity 11 when the grinding surface 221 is brought to contact and grind the part 121 of the inner peripheral surface 12. Furthermore, in step (b), the grinding portion 221 is moved away from the second position to a third position proximate to the mold cavity axis (Z) and back to the first position.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A machine-implemented method for forming a release surface of a mold, the mold having a mold cavity confined by an inner peripheral surface that defines a mold cavity axis, the release surface to be formed at the inner peripheral surface and being inclined relative to the mold cavity axis, comprising the steps of:

(a) bringing a grinding surface of a rotary grinding portion of a jig grinder into contact with a part of the inner peripheral surface such that the grinding surface is inclined at a predetermined angle relative to the mold cavity axis, and rotating the grinding portion such that the grinding surface grinds said part of the inner peripheral surface;

(b) separating the grinding surface from the inner peripheral surface;

(c) changing relative positions of the grinding portion and the inner peripheral surface in preparation for grinding another part of the inner peripheral surface; and (d) repeating the steps (a) to (c) until the release surface is formed.

2. The machine-implemented method of claim 1, wherein the grinding portion is moved into the mold cavity in step (a), and is moved out of the mold cavity in step (b).

3. The machine-implemented method of claim 2, wherein the jig grinder further includes a rotary rod connected to the grinding portion, and a main shaft connected to the rotary rod opposite to the rotary grinding portion and defining a rotary axis.

4. The machine-implemented method of claim 3, wherein the grinding portion is actuated by the main shaft so as to be rotatable about the rotary axis, and the grinding portion is moved into and out of the mold cavity along a displacement axis coaxial with the rotary axis.

5. The machine-implemented method of claim 4, wherein the rotary axis is parallel to the mold cavity axis, and the grinding surface is frusto-conical and forms the predetermined angle relative to the rotary axis.

6. The machine-implemented method of claim 1, further comprising, prior to step (a), placing the mold on a worktable which is movable on a plane perpendicular to the mold cavity axis, the step (c) including moving the worktable on the plane to change the relative positions of the grinding portion and the inner peripheral surface.

7. The machine-implemented method of claim 1, wherein the release surface formed in step (d) has an initial depth relative to the mold cavity axis, said machine-implemented method further comprising the step of repeating steps (a) to (d) to form the release surface with a depth larger than the initial depth.

8. The machine-implemented method of claim 2, wherein said jig grinder further includes a rotary rod connected to the grinding portion, an adjusting unit connected to the rotary rod opposite to the grinding portion, and a main shaft connected to the adjusting unit opposite to the rotary rod and defining a displacement axis parallel to the mold cavity axis.

9. The machine-implemented method of claim 8, wherein the grinding portion is rotatable about a rotary axis, and is actuated by the main shaft to move into and out of the mold cavity along the displacement axis parallel to the mold cavity axis, the grinding surface being cylindrical, the rotary axis being inclined at the predetermined angle relative to the mold cavity axis and the displacement axis.

10. The machine-implemented method of claim 9, wherein the release surface formed in step (d) is a continuous surface, the machine-implemented method further comprising, between steps (c) and (d), rotating the grinding portion about the displacement axis through the adjusting unit to adjust angular orientation of the grinding portion relative to the inner peripheral surface so as to ensure continuity of the release surface formed in step (d).

11. The machine-implemented method of claim 1, wherein, in step (a), the grinding portion is moved inclinedly relative to the mold cavity axis from a first position outwardly of the mold cavity to a second position within the mold cavity when the grinding surface is brought to contact and grind said part of the inner peripheral surface.

12. The machine-implemented method of claim 11, wherein, in step (b), the grinding portion is moved away from the second position to a third position proximate to the mold cavity axis and back to the first position.

13. A machine-implemented method for forming a release surface of a mold, the mold having a mold cavity confined by an inner peripheral surface that defines a mold cavity axis, the release surface to be formed at the inner peripheral surface and being inclined relative to the mold cavity axis, comprising the steps of:

(a) bringing a grinding surface of a rotary grinding portion of a jig grinder into contact with a part of the inner peripheral surface, the grinding surface being a taper surface that is inclined at a predetermined angle relative to the mold cavity axis, and rotating the grinding portion such that the grinding surface grinds said part of the inner peripheral surface;

(b) separating the grinding surface from the inner peripheral surface;

(c) changing relative positions of the grinding portion and the inner peripheral surface in preparation for grinding another part of the inner peripheral surface; and (d) repeating the steps (a) to (c) until the release surface is formed;

wherein the grinding portion is moved into the mold cavity in step (a), and is moved out of the mold cavity in step (b), the grinding portion being rotatable about a rotary axis parallel to the mold cavity axis, and being moved into and out of the mold cavity along a displacement axis coaxial with the rotary axis.

14. The machine-implemented method of claim 13, further comprising, prior to step (a), placing the mold on a worktable which is movable on a plane perpendicular to the mold cavity axis, the step (c) including moving the worktable on the plane to change the relative positions of the grinding portion and the inner peripheral surface.

15. The machine-implemented method of claim 13, wherein the release surface formed in step (d) has an initial depth relative to the mold cavity axis, said machine-implemented method further comprising the step of repeating steps (a) to (d) to form the release surface with a depth larger than the initial depth.

16. The machine-implemented method of claim 13, wherein, in step (a), the grinding portion is further moved inclinedly relative to the mold cavity axis from a first position outwardly of the mold cavity to a second position within the mold cavity when the grinding surface is brought to contact and grind said part of the inner peripheral surface.

17. The machine-implemented method of claim 16, wherein, in step (b), the grinding portion is moved away from the second position to a third position proximate to the mold cavity axis and back to the first position.

18. A machine-implemented method for forming a release surface of a mold, the mold having a mold cavity confined by an inner peripheral surface that defines a mold cavity axis, the release surface to be formed at the inner peripheral surface and being inclined relative to the mold cavity axis, comprising the steps of:

(a) bringing a cylindrical grinding surface of a rotary grinding portion of a jig grinder into contact with a part of the inner peripheral surface such that the grinding surface is inclined at a predetermined angle relative to the mold cavity axis, and rotating the grinding portion such that the grinding surface grinds said part of the inner peripheral surface;

(b) separating the grinding surface from the inner peripheral surface;

(c) changing relative positions of the grinding portion and the inner peripheral surface in preparation for grinding another part of the inner peripheral surface; and (d) repeating the steps (a) to (c) until the release surface is formed;

wherein the grinding portion is moved into the mold cavity in step (a), and is moved out of the mold cavity in step (b), the grinding portion being rotatable about a rotary axis, and being moved into and out of the mold cavity along a displacement axis parallel to the mold cavity axis, the rotary axis being inclined at the predetermined angle relative to the mold cavity axis and the displacement axis.

19. The machine-implemented method of claim 18, wherein the release surface formed in step (d) is a continuous surface, the machine-implemented method further comprising, between steps (c) and (d), rotating the grinding portion about the displacement axis to adjust angular orientation of the grinding portion relative to the inner peripheral surface so that an imaginary projecting line of the rotary axis is kept normal to a corresponding segment of a top edge of the inner peripheral surface.

20. The machine-implemented method of claim 18, further comprising, prior to step (a), placing the mold on a worktable which is movable on a plane perpendicular to the mold cavity axis, the step (c) including moving the worktable on the plane to change the relative positions of the grinding portion and the inner peripheral surface.

21. The machine-implemented method of claim 18, wherein the release surface formed in step (d) has an initial depth relative to the mold cavity axis, said machine-implemented method further comprising the step of repeating steps (a) to (d) to form the release surface with a depth larger than the initial depth.

* * * * *